US005304007A

United States Patent [19]

Flanagan

[11] Patent Number: 5,304,007

[45] Date of Patent: Apr. 19, 1994

[54] THERMAL PRINTHEAD BALANCED SPRING MOUNT

[75] Inventor: Edmund P. Flanagan, East Greenwich, R.I.

[73] Assignee: Gulton Industries, Inc., East Greenwich, R.I.

[21] Appl. No.: 696,249

[22] Filed: May 5, 1991

[51] Int. Cl.[5] ..... B41J 2/32

[52] U.S. Cl. ..... 400/120; 346/76 PH

[58] Field of Search ..... 400/120; 346/76 PH

[56] References Cited

U.S. PATENT DOCUMENTS

| | | | |
|---|---|---|---|
| 830,239 | 9/1906 | Lingenfelter | 267/158 |
| 3,190,632 | 6/1965 | Barenyi | 267/158 |
| 3,490,758 | 1/1970 | Foster | 267/158 |
| 4,170,422 | 10/1979 | Bilek | 400/120 |
| 4,460,170 | 7/1984 | Lundberg et al. | 267/158 |
| 4,517,573 | 5/1985 | Yang | 400/120 |
| 4,565,461 | 1/1986 | Usui et al. | 400/120 |
| 4,617,576 | 10/1986 | Moeller | 400/120 |
| 4,855,756 | 8/1989 | Gluck et al. | 400/120 |

FOREIGN PATENT DOCUMENTS

| | | | |
|---|---|---|---|
| 217187 | 10/1985 | Japan | 400/120 |
| 63470 | 4/1986 | Japan | 400/120 HE |
| 188164 | 8/1986 | Japan | 400/120 HE |
| 286767 | 12/1987 | Japan | 400/120 |
| 77751 | 4/1988 | Japan | 400/120 HE |
| 209965 | 8/1988 | Japan | 400/120 |

*Primary Examiner*—David A. Wiecking
*Attorney, Agent, or Firm*—Darby & Darby

[57] ABSTRACT

A thermal printhead spring mount is provided, wherein a spring engages a printhead carrier at two points along the width of the carrier, the points being equidistant from the center of the carrier. A cam engages the center of the spring and selectively biases the spring against the carrier. The spring transfers equal force to the two points, creating a balanced carrier. By releasing cam force from the spring, through simple rotation, tension is relieved in the spring.

17 Claims, 2 Drawing Sheets

THERMAL PRINTHEAD BALANCED SPRING MOUNT

FIELD OF THE INVENTION

The invention relates generally to arrangements for mounting printheads, and more specifically, to an apparatus for mounting a thermal printhead which produces a substantially balanced force of the printhead against a print-receiving medium.

BACKGROUND OF THE INVENTION

When using a thermal printhead, the problems associated with mounting the printhead to ensure even printing across the full row of printing elements are well known. As used herein, the phrase "even printing" means that each printing element will produce a substantially equally dark dot when fully energized. The aforesaid known problems are especially troublesome in the case of wide printheads, i.e., on the order of 10 inches. Such printheads are desirable, however, as they can print all the characters of an entire line of an ordinary $8\frac{1}{2}\times 11$ or A4 sheet of paper simultaneously. Uneven force of the printhead against the print-receiving medium can create varying contrast with light or dark zones within the printed line.

When the thickness of a print-receiving medium, such as heat-sensitive paper, is uneven, the printhead mounting arrangement also must be able to compensate for the variations in paper thickness while maintaining even printing.

U.S. Pat. No. 4,855,756 discloses an apparatus comprising a combination of two springs, sliding frames and a computer-controlled cam. The printhead in this apparatus is mounted on a holder that is pivoted on a shaft and supported by a C-shaped spring. The C-shaped spring biases the holder to a position parallel to a print-receiving medium. When an uneven medium is placed under the printhead, the C-shaped spring deforms irregularly. This may lead to uneven pressure on the medium. Thus, this apparatus, while perhaps compensating for some variations in thickness, is complex and would require extensive disassembly for maintenance and repair.

U.S. Pat. No. 4,235,555 discloses a printer having multiple printheads wherein each printhead is balanced by applying pressure at one central point. The head is otherwise connected at two nearby points by a resilient bracket, with deformation of the bracket allowing for minor variations in the paper. Again, however, the system involves several small printheads, movable brackets, arms, cams, springs and levers, which make it very complex to produce and difficult to repair and maintain.

Thus, it is an object of the invention to provide an improved printhead mount that causes the force between the printhead and the print-receiving medium to be substantially equal along the width of the printhead.

It is another object of the invention to provide a printhead mount that can compensate for variations in the thickness of a print-receiving medium, even where such variations occur across the width of the medium.

It is another object of the invention to provide a printhead mount that meets the foregoing objects, yet is easily engaged and released, allowing for simple maintenance and repair.

It is still another object of the invention to provide a printhead mount that is economical, both in the number and cost of the component parts, and is simple to manufacture.

SUMMARY OF THE INVENTION

In accordance with the invention, a thermal printhead spring mount is provided, wherein a spring engages a printhead carrier at two points along the width of the carrier, the points being equidistant from the center of the carrier. A cam engages the center of the spring and selectively biases the spring against the carrier. The spring transfers equal force to the two points, creating a balanced carrier. By releasing cam force from the spring, through simple-rotation, tension is relieved in the spring.

BRIEF DESCRIPTION OF THE DRAWINGS

The foregoing and other objects and advantages of this invention will become apparent to those skilled in the art upon reading the detailed description of a preferred embodiment in conjunction with a review of the appended drawings, in which.

DETAILED DESCRIPTION OF THE PREFERRED EMBODIMENTS

Figure 1:
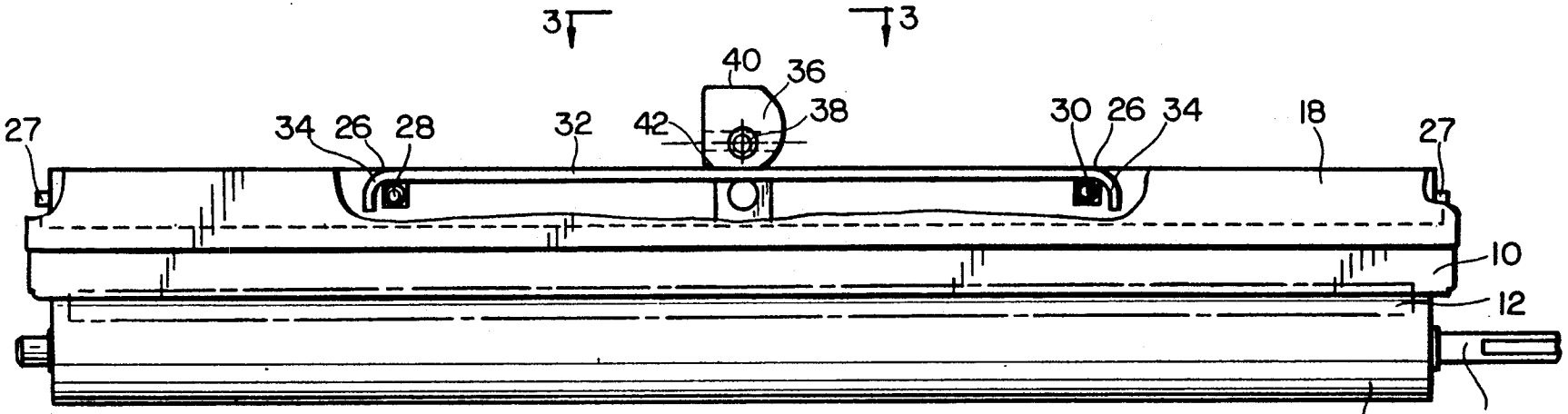
FIG. 1 is a front view of a thermal printhead spring mount according to the invention.

Now referring to the drawings, a portion of a thermal printing apparatus is shown, including a printhead 10 having a plurality of heating elements disposed at least across its width for printing graphic and/or alphanumeric information on a print-receiving medium 12, such as a heat-sensitive paper. The paper 12 is caused to travel laterally to the printhead 10 (out of the plane of FIGS. 1 and 2) by a roller 14, which rotates on a shaft 16 connected to a drive system (not shown), as is customary. Alternatively, the paper 12 may pass between the printhead 10 and a stationary platen, as is also known. It is to be understood that the printhead spring mount of the invention can be used for any type of conventional printhead, but is preferably used for a thermal-type head, such as a thermal transfer or direct heating type.

The printhead 10 is conventionally electrically connected to a controlling system (not shown) that energizes the heating elements in a desired sequence to cause corresponding desired information to appear on the paper 12. The printhead 10 is physically connected to a carrier 18 which supports the printhead 10. This can be accomplished in any known way, such as adhesives, fasteners, or an interlocking fit. Downward forces applied to the carrier 18 are thus transmitted to the printhead 10 (as in FIG. 1), toward the paper 12. Constant printhead pressure on the paper 12 is necessary during printing as direct contact is needed to cause proper thermal transfer (i.e., sufficient heating of the paper) to take place. The pressure must also be maintained substantially equally along the entire width of the printhead 10 to ensure that no relatively darker or lighter spots will appear anywhere on the printed page 12 (where such differences in contrast are not intentionally caused by varying levels of energization of the printing elements).

Figure 3:
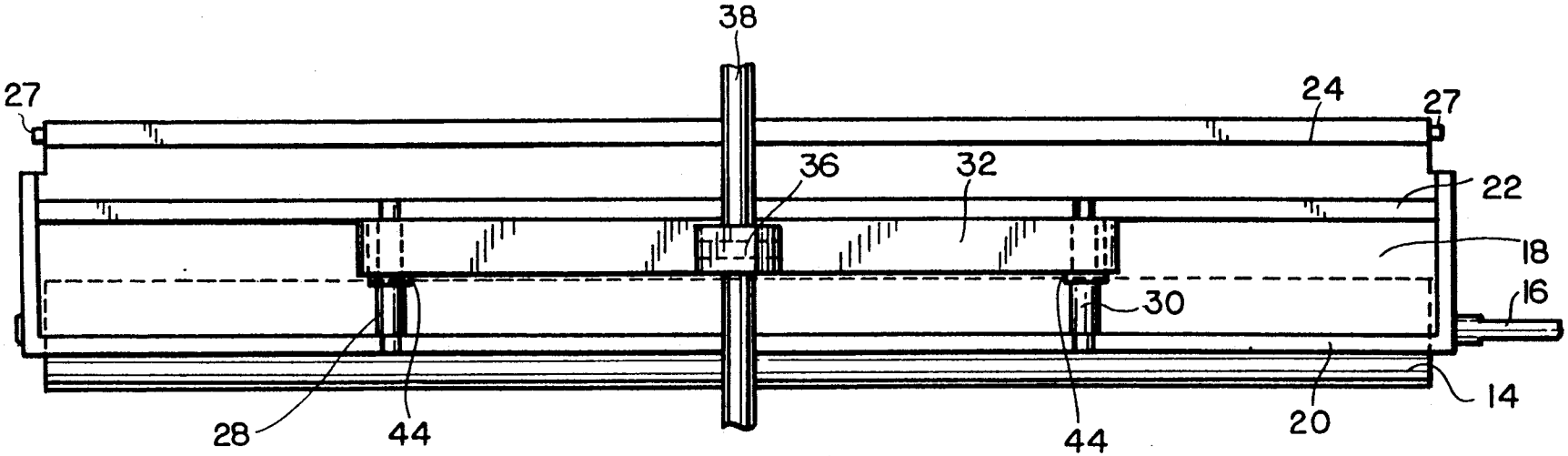
FIG. 3 is a top view taken along the direction shown in FIG. 1.

The carrier 18 is preferably a generally flat rectangular plate with three support walls 20,22,24 upwardly at the front, middle, and rear, respectively (see FIG. 3). The carrier could be any block shape, as long as it mates with the printhead and provides an even pressure surface against the printhead. At positions corresponding to approximately one-quarter and three-quarters of the width of the carrier are slots 26 cut into the top of the front and middle walls 20, 22 of the carrier 18 in this presently preferred embodiment.

The carrier 18 is attached to the printer housing (not shown) at two points 27 at the ends of the rear wall 24. This generally limits translation of the carrier 18 in the horizontal direction, but permits rotation of the carrier 18 about an axis defined by the two points 27. This attachment, along with the spring apparatus of the invention causes the printhead 10 to rest in a substantially aligned position with respect to the roller 14 and print-receiving medium 12.

Downward movement of the front end of printhead 10 is physically limited by interference of the roller 14. During printing, force on the carrier 18 downward causes pressure of the carrier 18 and printhead 10 against the roller 14 and the medium 12 therebetween. To obtain downward force on the carrier 18, the ends of a single flat spring 32 are positioned in direct contact with two posts 28,30 attached to the carrier 18. In the preferred embodiment, the ends of each post 28,30 rest in a slot 26, so that the posts are perpendicular to the roller, with one post on either side of the carrier's center, equidistant from the center. The posts 28,30 are retained in the carrier by being wider than the slots 26, but having smaller ends that fit in the slots. The posts 28,30 abut the bottom edges of the slots 26 transferring any force applied on them from the spring 32 to the carrier 18 and biasing the carrier 18 and printhead 10 against the roller 14. The posts 28,30 could be integrally molded with the carrier, and can have any shape that provides a bearing surface for the spring 32. By modifying the shape of the spring 32, the ends of the spring could be attached directly to the carrier.

The spring 32 is formed of a resilient material, such as spring steel, although any suitable spring material may be used. The spring 32 is preferably generally planar but has two curved end portions or right angle bends 34, one at each end, curving downwardly toward the printhead 10. These angle bends extend partially around the two posts 28,30. However, the spring 32 is slightly oversized with respect to the posts, so that the posts do not closely locate in the corners of the angle bends 34. Instead the posts 28,30 engage the spring 32 slightly toward the center, in this preferred embodiment, for reasons which will be made clear below.

Figure 2:
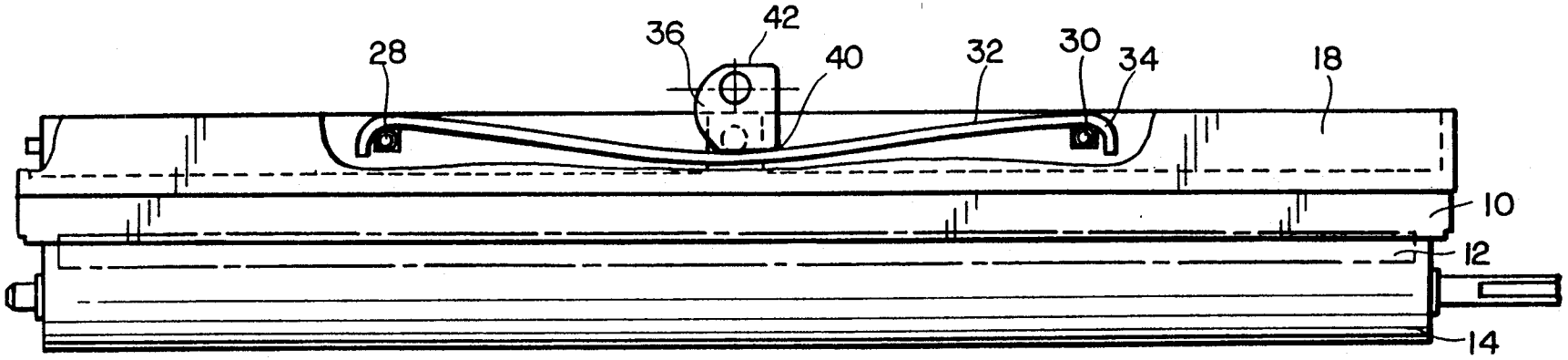
FIG. 2 is a front view of a thermal printhead spring mount with the spring biased toward the printhead.

Pressed against the opposite side of the spring from the posts is a cam 36 mounted on a cam shaft 38, which selectively displaces the center of the spring 32 between an idle position, shown in FIG. 1, and a printing position, shown in FIG. 2. Two surfaces 40,42 on the cam 36 corresponding to these spring positions selectively abut the spring 32 and are preferably on opposite sides of the cam, although they could be positioned at any two exclusive areas along the perimeter. Between the surfaces 40,42 is preferably a rounded edge to facilitate rotation of the cam between the two positions.

As can be seen in FIG. 1, the spring 32 is in its idle position, held in place by the two posts 28,30 on one side of the spring, and the "idle" surface 42 of the cam 36 on the other. In this position, minimal pressure is exerted on the carrier 18 and printhead 10 assembly.

In FIG. 2, it is to be understood that the cam 36 has been rotated clockwise 180° and now has its "print" surface 40 abutting the spring 32. As can be seen in the figure, the cam 36 displaces the center of the spring downward by a significant distance, about 0.25 inch in the preferred embodiment. Two downward forces of equal magnitude, depending on the rigidity of the spring 32, will be applied to the posts 28,30 simultaneously. In the presently preferred embodiment, the downward forces are on the order of six pounds-force at each post. Since the posts 28,30 are positioned at approximately one-quarter and three-quarters the width of the carrier 18, they will distribute the force evenly along the entire width of the printhead 10

It is thus seen that if the middle of the flat spring 32 is displaced laterally (in the embodiment of FIGS. 1,2 and 3), while the two ends are immobile along the same direction, the overall longitudinal extent of the spring 32 will decrease an amount proportional to the displacement. To compensate for this effect, the posts 28,30 do not sit in the end corners of the spring, but are set inward slightly, so that the ends of the spring have some freedom to travel inwardly towards the cam position while maintaining only downward force. The right angle bends prevent the spring 32 from travelling too far on the posts 28,30, in which case the spring 32 might possibly dislodge itself from the carrier 18 entirely. The s is preferably prevented from forward movement by grip rings 44 on the posts 28,30. Rearward movement is prevented by the middle wall 22.

Figure 4:
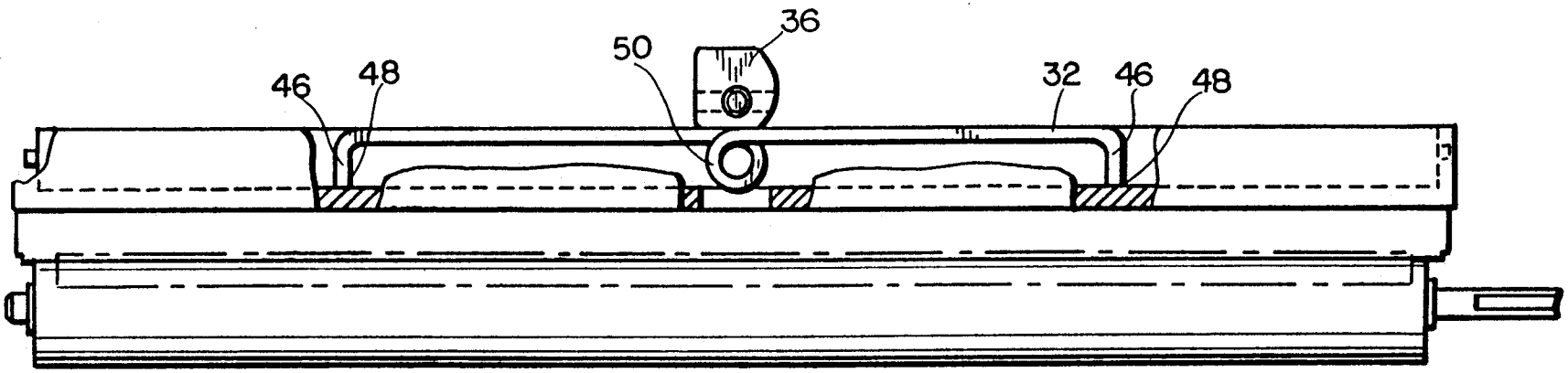
FIG. 4 is a front view of a thermal printhead spring mount according to another embodiment of the invention.

In an alternative embodiment, shown in FIG. 4, the two ends 46 of the spring 32 are attached directly to the carrier 18 at points 48. In this embodiment, the spring 32 has a loop 50 in its midsection, which is abutted by the cam 36 and displaced in a similar manner to the preferred embodiment. Since the ends 46 are stationary, when cam 36 displaces the spring 32, the ends 46 can not travel inwardly to the cam 36 position, as in the preferred embodiment. Instead, the loop 50 becomes slightly smaller, increasing the overall length of the spring 32. In operation, this embodiment is identical to the preferred embodiment.

Again referring to the preferred embodiment of FIGS. 1,2 and 3, it can be seen from the geometry that the force on the two posts 28,30 will always be equal. If a paper 12 or other medium between the printhead 10 and the roller 14 is slightly thicker on one side than the other, that side of the carrier 18 will be forced upward slightly. The corresponding post and end of the spring will also be moved upward. However, since the only downward force on the spring is acting from the center of the spring 32, the two forces on the posts 28,30 will remain equal and the printing pressure will also remain constant over the entire width of the printhead 10.

The simple movement of the cam 36 from its idle to print positions allows for easy maintenance, repair, or removal of the carrier 18, printhead 10 or surrounding components. By rotating the cam 36 counter-clockwise, back to the position shown in FIG. 1, the printhead pressure is relieved. Paper jams can also be easily corrected by this procedure.

Thus, it can be seen that a simple printhead can be manufactured that is simple, yet applies even force to a print-receiving medium and compensates evenly for variations in the medium thickness.

While the embodiment of the invention shown and described is fully capable of achieving the results desired, it is to be understood that this embodiment has been shown and described for purposes of illustration only and not for purposes of limitation.

What is claimed is:

1. In a spring mount for a printing apparatus having a printhead for printing graphic information on a recording medium and a platen for supporting said medium against said printhead along a printing line direction, the improvement comprising:

a carrier attached on a first side thereof to said printhead and movably attached to said printing apparatus, said carrier having a width along said printing direction, said carrier being substantially stationary along said printing direction with respect to said platen;

a spring abutting said carrier on a second side of the carrier opposite said first side at two points, said two points being substantially equidistant from the center of said carrier along said direction and said two points being positioned at substantially one-quarter and three-quarters of the width of said carrier in said direction whereby said printhead is biased toward said medium with even pressure over the entire printhead; and a cam abutting said spring at one area of said spring over said center of said carrier, said cam selectively deflecting said area of said spring toward said first side such that said carrier and said printhead are biased toward said medium.

2. A spring mount as in claim 1 wherein said spring is flat and fashioned from a resilient metal.

3. A spring mount as in claim 1 further comprising two posts mounted on said carrier at said two points, said spring abutting said posts on said carrier.

4. A spring mount as in claim 3 wherein said posts are perpendicular to said direction, said spring being generally parallel to said direction.

5. A spring mount as in claim 4 wherein said spring is a generally flat strip of a resilient metal, said spring having two curved ends, the ends abutting said posts.

6. A spring mount as in claim 1 where in said cam has two flat areas on its perimeter, said flat areas having a smaller and a greater radius, respectively.

7. A spring mount as in claim 6 wherein said flat areas are connected by rounded transition areas.

8. A spring mount as in claim 7 wherein when said cam area having a smaller radius abuts said spring, said spring is substantially relaxed and when said cam area having a greater radius abuts said spring, said one area of said spring is deflected toward said carrier, tensioning said spring.

9. In a spring mount for a printing apparatus having a printhead for printing graphic information on a recording medium and a platen for supporting said medium against said printhead along a printing line direction, the improvement comprising:

a carrier attached on a first side thereof to said printhead and movably attached to said printing apparatus;

a spring abutting said carrier on a second side of the carrier opposite said first side at two points, said two points being substantially equidistant from the center of said carrier along said direction;

a cam abutting said spring at one area of said spring over said center of said carrier, said cam selectively deflecting said area of said spring toward said first side such that said carrier and said printhead are biased toward said medium;

further comprising two posts mounted on said carrier at said two points, said spring abutting said posts on said carrier, wherein said posts are perpendicular to said direction, said spring being generally parallel to said direction;

wherein said spring is a generally flat strip of a resilient metal, said spring having two curved ends, the ends abutting said posts; and wherein the distance between said curved ends is greater than the distance between said posts.

10. In a spring mount for a printing apparatus having a printhead for printing graphic information on a recording medium and a platen for supporting said medium against said printhead along a printing line direction, the improvement comprising:

a carrier attached on a first side thereof to said printhead and movably attached to said printing apparatus;

a spring abutting said carrier on a second side of the carrier opposite said first side at two points, said two points being substantially equidistant from the center of said carrier along said direction;

a cam abutting said spring at one area of said spring over said center of said carrier, said cam selectively deflecting said area of said spring toward said first side such that said carrier and said printhead are biased toward said medium;

further comprising two posts mounted on said carrier at said two points, said spring abutting said posts on said carrier, wherein said posts are perpendicular to said direction, said spring being generally parallel to said direction;

wherein said spring is a generally flat strip of a resilient metal, said spring having two curved ends, the ends abutting said posts; and wherein said posts are positioned at substantially one-quarter and three-quarters of the width of said carrier in said direction whereby said printhead is biased toward said medium with even pressure over the entire printhead.

11. In a spring mount of a printing apparatus having a printhead that is selectively biased toward a platen, the improvement comprising:

a carrier attached to said printhead away from said platen, said carrier having a width, said carrier having a resilient portion parallel to said platen and extending away from said printhead, said resilient portion having at least two sections that are substantially equidistant from the center of said carrier and that are positioned at substantially one-quarter and three-quarters of the width of said carrier, said carrier being substantially stationary along said platen; and a cam abutting said resilient portion and selectively deflecting said portion such that said printhead is biased toward said platen with even pressure over the entire printhead.

12. A spring mount as in claim 11 wherein said portion is evenly divided by a centerline of said carrier along a direction parallel to said platen.

13. A spring mount as in claim 12 wherein said portion is a generally flat strip of resilient metal having curved ends, said curved ends attached to said carrier.

14. A spring mount as in claim 13 wherein said strip includes a loop.

15. In a printing apparatus having a printer housing, said printing apparatus for printing graphic information on a recording medium, the improvement comprising:

a platen connected to said housing for supporting said medium along a printing line direction;

a printhead mounted in said housing for producing said graphic information;

a carrier attached to said printhead and movably attached to said printing apparats, said carrier having a width along said direction;

spring means abutting said carrier opposite said printhead at two points, said two points being substantially equidistant from the center of said carrier along said direction, said points being positioned at substantially one-quarter and three-quarters of the width of said carrier in said direction; and a cam abutting said spring means at one area of said spring means over said center of said carrier, said cam selectively deflecting said area of said spring means toward said printhead, biasing said carrier toward said printhead and biasing said printhead toward said platen with an even pressure over the entire printhead.

16. In a printing apparatus having a printhead, a platen and a spring mount for biasing the printhead against the platen, the improvement comprising:

a carrier attached to said printhead away from said platen;

a spring having two curved ends attached to said carrier, said spring being generally parallel to said platen and extending away from said printhead, said spring being a generally flat strip of resilient metal including at least one loop; and cam means abutting said spring and selectively deflecting said spring such that said printhead is biased toward said platen.

17. A spring mount as in claim 16 wherein said cam means is a cam and said cam abuts said spring at said loop.

* * * * *